United States Patent [19]

Lyons

[11] 4,030,426

[45] June 21, 1977

[54] TRAV-L-SAFE

[76] Inventor: Joseph Lyons, 35 Bonnie Lane, Berkeley, Calif. 94708

[22] Filed: May 23, 1975

[21] Appl. No.: 580,309

[52] U.S. Cl. ..... 109/51; 109/54

[51] Int. Cl.[2] ..... E05G 1/02

[58] Field of Search ..... 109/23, 45, 50, 51, 109/52, 54, 56, 57, 58, 64, 78, 80; 150/49; 70/57, 58, 85; 248/203; 211/4; 312/204

[56] References Cited

UNITED STATES PATENTS

| | | | |
|---|---|---|---|
| 191,729 | 6/1877 | Thompson et al. | 109/45 UX |
| 479,464 | 7/1892 | Root | 109/57 X |
| 963,883 | 7/1910 | Farley | 109/51 |
| 1,184,094 | 5/1916 | Harrington | 109/57 |
| 1,206,618 | 11/1916 | Thrasher et al. | 150/49 X |
| 3,587,486 | 6/1971 | Heinrichs | 109/51 |

FOREIGN PATENTS OR APPLICATIONS

| | | | |
|---|---|---|---|
| 124,165 | 3/1919 | United Kingdom | 109/52 |

*Primary Examiner*—Paul R. Gilliam
*Assistant Examiner*—David H. Corbin

[57] ABSTRACT

A portable strong box is provided with restraining means arranged to project from the box and to be adjustable from inside only of the box to engage surrounding surfaces of a desk or bureau drawer to secure the box therein against unlawful removal.

3 Claims, 3 Drawing Figures

TRAV-L-SAFE

BACKGROUND OF INVENTION

For people who travel a great deal and are obliged frequently to put up in hotel or motel rooms the matter of protecting things of value such as jewelry, watches, money and the like against pilferage can be a serious problem. It would be desirable therefor to be able to keep such valuables in a strong box that was portable and of a construction that would require minimum space in one's bags; and which, when in use could be secured in a desk or bureau drawer in such a manner that the drawer could be used but the box could not be removed therefrom except by the owner.

Although portable strong boxes can be found in the prior art, as illustrated, for example, by U.S. Pat. No. 963,883and U.S. Pat. No. 358,7486,these are made of rigid materials such as sheet steel, are not collapsible and are intended to be firmly secured to a suspporting surface by permanent fastening means such as screws or bolts; or as illustrated by the treasure box in U.S. Pat. No. 345,302—by an external clamp.

However none of these earlier devices are designed to be carried, conveniently, in a suitcase or bag; and in each instance would permanently deface the surface to which they were attached— thus rendering these boxes wholly impractical for the traveler staying in a hotel or motel room.

SUMMARY OF INVENTION

The present invention relates to a portable strong box which, when not in use, can be collapsed for convenience in carrying in a bag or suitcase; and which when assembled and placed in a desk or bureau drawer can be held securely therein against unlawful removal while permitting normal use of the drawer, the essence of the invention being the use of adjustable restraining means mounted in the ends and top of the box and adapted to be adjustable only from within the box to firmly engage adjacent surfaces of the drawer and desk or bureau top; and which, when adjusted, can be released only by first unlocking the box. In addition, the invention comprehends making the body of the box of a strong flexible material such as a woven metal fabric or mesh.

PREFERRED EMBODIMENT OF THE INVENTION

Figure 1:
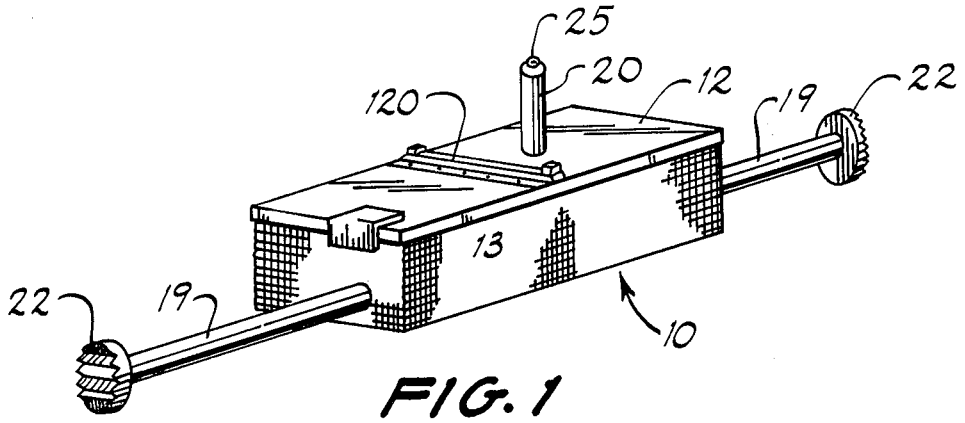
FIG. 1 is a prespective view of the strong box of this invention showing the restraining means in expanded position.

Referring to the drawings FIG. 1 is a perspective view of the strong box of this invention which is indicated generally by the numeral 10. The box is substantially rectangular and its length is preferably several times its width; its length in particular having a significant bearing on the use of the strong box in a desk or bureau drawer, as hereinafer described.

Figure 2:
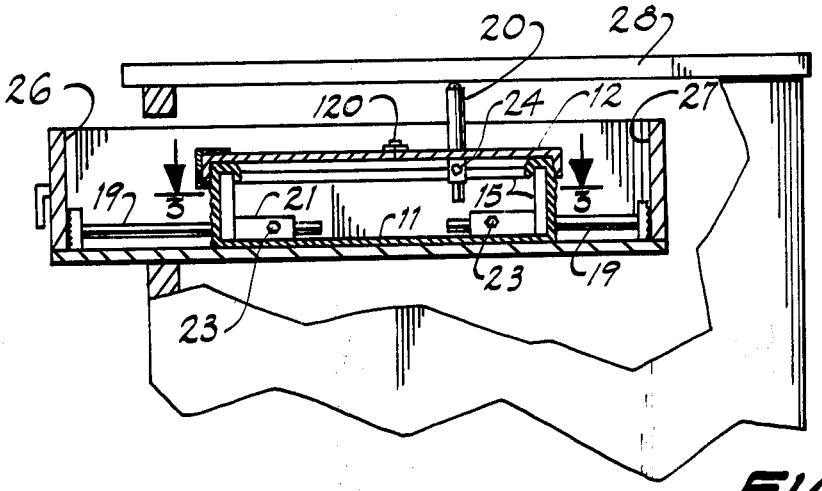
FIG. 2 is a side elevation, in section, of the strong box of FIG. 1.
Figure 3:
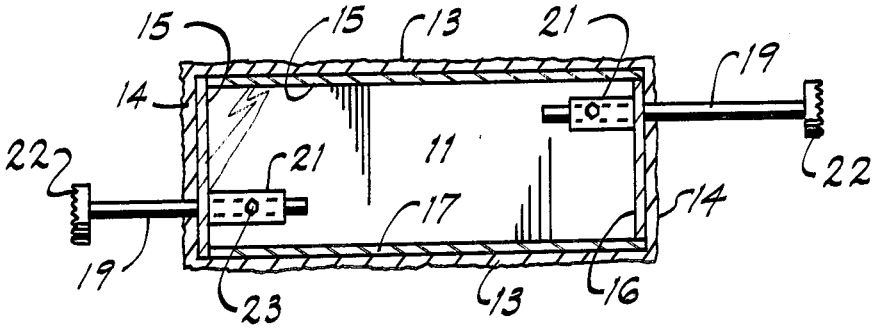
FIG. 3 is a plan view of the strong box showing details of the box restraining means.

As shown especially well in FIGS. 2 and 3 the bottom 11 and top 12 of the box are substantially rectangular, of substantially equal size and each comprises a piece of sheet metal, as for example sheet steel or steel alloy, sufficiently thick to be rigid and to resist destruction by anything but sophisticated burglary tools.

As mentioned above a novel feature of the strong box of this invention is that it is portable and constructed so as to pack readily in a bag or suitcase. To this end it is collapsible, its sides 13 and ends 14 being made of a strong flexible material as for example a woven metal mesh such as the flexible metal materials used in the manufacture of bullet proof vests. The bottom edges of the flexible sides 13 and ends 14 are formed integrally with the corresponding edges of the bottom 11 of the box.

When in use the flexible sides and ends of the box are adapted to be supported by a removable, substantially rectangular frame-member, indicated generally at 15, dimensioned to fit snugly inside the box. The frame-member 15 is designed to be collapsible and to this end comprises separate side and end pieces 16 and 17 respectively provided with interlocking means at the corresponding ends whereby they may be assembled within the box to form a substantially rigid frame. As shown in FIG. 2 support for the flexible sides and ends of the box is provided by engagement of the upper edges of the frame 15 in hem-like folds formed at the upper edges of the flexible sides 13 and ends 14 of the box.

The sheet metal top 12 of the box is adapted to fit tightly over the upper edges of the box to be locked to its front end by a combination lock or the like. The top 12 is made in two pieces held together by a hinge 120.

The restraining means for securing the strong box in a desk drawer against unlawful removal comprises a pair of rods 19—19 arranged to extend from within the box outwardly through the ends thereof, respectively; and a restraining rod 20 extending upwardly from the top of the box. Each restraining rod is made of steel and stiff enough to resist deformation except under extraordinary conditions; and short enough to be stored in the collapsed box during travel.

Referring particularly to FIG. 3 each restraining rod 19 is adapted to be slidingly supported at its inner end in a cylindrical metal sleeve 21 welded or otherwise secured to the sheet metal bottom of the box, each cylindrical sleeve 21 being arranged at each end respectively of the box as shown especially well in FIG. 3. Further , the outer end of each restraining rod 19 is provided with a shoe 22 the outer face of which is serrated so that when forced with contact with an adjacent wall of the drawer it will not slip.

Moreover each rod 19 is adapted to be locked in adjusted position in its cylindrical sleeve 21 be a radial screw 23 threaded therein and operable by a hex wrench or the equivalent.

The restraining rod 20 in the cover 11 is similarly mounted in a cylindrical sleeve 24 secured to the underside of the cover substantially perpendicular to the plan thereof the sleeve 24 also being provided with a radial screw 23 by which the rod 20 can be locked in its adjusted position in the sleeve 24.

The upper end of the rod 20 is provided with antifriction means which in the present embodiment comprises a steel or plastic ball 25 partially encapsulated in the end of the rod 20.

While the longitudinally adjustable restraining rods represent one embodiment of the invention it will be understood that the restraining means may take other forms as for example telescoping rods.

The strong box is adapted to be used as follows: after the collapsed strong box has been assembled, as hereinabove described, it is then placed in a desk or bureau drawer, preferably the top drawer, in which its firmly secured against unlawful removal by first sliding the rods 19—19 outwardly sufficiently to engage their respective shoes against the front and back walls 26 and 27 of the drawer whereupon the rods are locked in position by tightening the radial screws 23. The rod 20 in the cover 12 is then adjusted so that when the cover is closed the ball 25 engages the underside of the top 28 of the desk or bureau. After putting one's valuables in the box the cover is closed and licked. It is then virtually impossible either to open the box or remove it from the drawer without first unlocking the cover and releasing the restraining rods. Moreover since the restraining rod 20 has a ball 25 at its upper end the drawer may be moved in and out as in normal use but cannot be completely removed from the desk or bureau because of engagement of the upper end of the rod 20 with the frame member 29.

The invention may be carried out in other specific ways than those herein set forth without departing from the spirit and essential characteristics of the invention and the present embodiment is therefore to be considered in all respects as illustrative and not restrictive, and all changes coming within the meaning and equivalency range of the appended claims are intended to be embraced therein.

1 claim:

1. A portable rectangular strong box adapted to be secured temporarily in the drawer of a desk or bureau against unlawful removal said portable strong box comprising: a bottom, integral substantially perpendicular sides and ends, each end having a horizontal aperture therein, and a two-part cover, one part of which has a vertical aperture therein, the said one part of said cover being fixed to the adjacent upper edges of said sides and to the adjacent upper edges of the corresponding end of said box, a hinge secured to the fixed one part of said cover, said hinge constructed and arranged to connect the second part of said cover to the fixed one part thereof, locking-means mounted on said second cover part constructed and arranged to releasably lock the hinged second cover part to the corresponding end of said box, box securing means within said box comprising three metal rods each rod having an inner end and an outer end, a pair of rod supporting means housed within said box each comprising a cylindrical sleeve fixed to the bottom of said box and at opposite ends thereof, respectfully, the longitudinal axis of each of said pair of sleeves being parallel to the plane of the bottom of said box, substantially at right angles to the plane of the corresponding apertured end thereof and in axial alignment with the horizontal aperture therein, the inner end of each rod of a pair of said metal rods being slidingly mounted in one of the cylindrical rod supporting sleeves and the length of each rod of said pair of rods being such that its outer end extends through the aperture in the corresponding end of said box to contact a corresponding wall of said drawer, rod fastening means within said box comprising a set screw in each of said rod supporting sleeves constructed and arranged to hold each rod of said pair of rods temporarily in its extended position in contact with the corresponding wall of said drawer, third rod supporting means comprising a third cylindrical sleeve, said third cylindrical sleeve secured on the underside of the apertured fixed cover part substantially perpendicular to the plane thereof and in axial alignment with the vertical aperture therein, the inner end of said third rod being slidably mounted in said third cylindrical sleeve the length of said third rod being such that its outer end extends through the vertical aperture in the fixed cover part to contact the underside of the top of said desk or bureau, and third rod fastening means comprising a set screw in said third cylindrical sleeve, said third set screw arranged to hold said third rod temporarily in its extended position in said third cylindrical sleeve in contact with the underside of the top of said desk or bureau.

2. A portable strong box according to claim 1 wherein the sides and ends of said box are formed of a flexible metallic material, each of said sides and ends having a hem-like fold along its upper edge, a rectangular, and demountable substantially rigid frame mounted in said box said frame constructed and arranged to support the flexible sides and ends of said box, said demountable frame comprising rigid plate-like side members and end-members the upper edges of which are constructed and arranged to engage in the hem-like folds of the flexible sides and ends of said box, and interlocking means at the adjoining end-members and side members of said frame.

3. A portable strong box according to claim 1 wherein the outer end of each rod of said pair of rods is provided with a shoe having a serrated outer surface and the outer end of said third rod is provided with anti-friction means comprising a partially encapsulated ball.

* * * * *